US007407117B2

(12) United States Patent
Dodd

(10) Patent No.: US 7,407,117 B2
(45) Date of Patent: Aug. 5, 2008

(54) LIQUID SPRAYER ASSEMBLY

(75) Inventor: Joseph K. Dodd, Lee's Summit, MO (US)

(73) Assignee: MeadWestvaco Calmar, Inc., Grandview, MO (US)

( * ) Notice: Subject to any disclaimer, the term of this patent is extended or adjusted under 35 U.S.C. 154(b) by 332 days.

(21) Appl. No.: 11/116,030

(22) Filed: Apr. 27, 2005

(65) Prior Publication Data

US 2006/0091237 A1 May 4, 2006

Related U.S. Application Data

(63) Continuation-in-part of application No. 10/974,708, filed on Oct. 28, 2004, now Pat. No. 7,188,786.

(51) Int. Cl.
*B05B 7/26* (2006.01)

(52) U.S. Cl. ..... 239/310; 239/315; 239/318; 239/316; 239/347; 222/145.8; 222/481; 222/484

(58) Field of Classification Search ..... 239/581.1, 239/581.2, 582.1, 310, 400, 318, 347, 348, 239/354, 407, 413, 414, 315, 316, 10; 220/524; 222/481, 481.5, 482, 484
See application file for complete search history.

(56) References Cited

U.S. PATENT DOCUMENTS 3,034,731 A * 5/1962 Chapin ..... 239/318
3,186,643 A * 6/1965 George et al. ..... 239/318
3,269,389 A 8/1966 Meurer et al.
3,291,395 A 12/1966 Sharp
3,764,074 A * 10/1973 James ..... 239/318
3,770,205 A * 11/1973 Proctor et al. ..... 239/317
3,779,414 A 12/1973 Jones
3,841,513 A 10/1974 O'Connor et al.
3,940,069 A * 2/1976 Gunzel et al. ..... 239/318
4,033,509 A * 7/1977 Sheets ..... 239/226

(Continued)

OTHER PUBLICATIONS

Infinity: Hose-End Sprayer. Brochure. Saint-Gobain Calmar Inc. Lee's Summit, MO, 2003. (1 page).

*Primary Examiner*—Kevin P. Shaver
*Assistant Examiner*—Trevor E. McGraw
(74) *Attorney, Agent, or Firm*—Gordon & Jacobson, PC

(57) ABSTRACT

An improved liquid sprayer assembly for connection to a container (which preferably includes two liquid storage compartments) has a housing that includes a container mount having an underside with at least one structure that is operably interposed with corresponding structure on a neck portion of the container such that the container mount is fixed in a predetermined orientation relative to the container. A cap locks the container mount to the neck portion of the container. Preferably, the at least one structure of the container mount comprises a pair of wedge-shaped wall structures together with a plurality of wall structures that extend in a directional substantially parallel to the central axis of the mount/neck. The wedge-shaped wall structures are radially disposed opposite one another about the central axis of the container mount/neck and fit within wedge-shaped voids defined by the neck portion of the container. The plurality of wall structures are operably disposed adjacent corresponding surfaces defined by the neck portion of the container. Preferably, the sprayer employs a hose end connector as well as a venturi tube for aspirating liquid from the container. Preferably, a diverter mechanism, which is mounted within the housing, selectively couples the liquid storage compartment(s) of the container to the inlet port of the venturi tube, and a flow control valve controls the flow of pressurized liquid supplied from the hose end into the venturi tube.

24 Claims, 4 Drawing Sheets

U.S. PATENT DOCUMENTS 4,057,940 A * 11/1977 Wemmer ..... 451/101
4,349,157 A * 9/1982 Beiswenger et al. ..... 239/509
4,369,921 A * 1/1983 Beiswenger et al. ..... 239/317
4,382,552 A * 5/1983 Lubsen et al. ..... 239/317
4,527,740 A * 7/1985 Gunzel et al. ..... 239/318
4,595,127 A * 6/1986 Stoody ..... 222/135
4,600,130 A * 7/1986 Libit ..... 222/209
D284,988 S * 8/1986 Powell ..... D23/223
4,614,437 A 9/1986 Buehler
4,750,674 A * 6/1988 Chow et al. ..... 239/318
4,767,058 A * 8/1988 LaRosa et al. ..... 239/309
4,881,575 A 11/1989 Smith
4,901,923 A * 2/1990 McRoskey et al. ..... 239/123
4,923,098 A * 5/1990 Schoonover et al. ..... 222/465.1
5,007,588 A * 4/1991 Chow et al. ..... 239/318
5,039,016 A * 8/1991 Gunzel et al. ..... 239/314
5,062,550 A 11/1991 Singh
D323,980 S * 2/1992 Perrin ..... D9/742
5,100,059 A * 3/1992 Englhard et al. ..... 239/310
5,183,206 A * 2/1993 Gavin ..... 239/317
5,213,265 A * 5/1993 Englhard et al. ..... 239/310
5,320,288 A * 6/1994 Ketcham, Jr. ..... 239/316
5,332,157 A * 7/1994 Proctor ..... 239/304
5,372,310 A * 12/1994 Ketcham ..... 239/317
5,375,769 A * 12/1994 Schultz ..... 239/310
5,383,603 A * 1/1995 Englhard et al. ..... 239/314
5,398,846 A * 3/1995 Corba et al. ..... 222/1
D361,509 S * 8/1995 Dull et al. ..... D9/742
5,472,119 A * 12/1995 Park et al. ..... 222/145.8
5,595,345 A * 1/1997 Chura et al. ..... 239/312
5,609,299 A 3/1997 Foster et al.
H1691 H * 11/1997 Ono et al. ..... 239/3
5,735,422 A * 4/1998 Binter ..... 220/4.21
5,804,082 A * 9/1998 Lowery, Jr. ..... 210/800
5,823,391 A * 10/1998 Klauke et al. ..... 222/94
5,836,479 A 11/1998 Klima et al.
5,853,114 A * 12/1998 Giovanoli ..... 222/479
5,944,259 A * 8/1999 Brown ..... 239/414
D414,104 S * 9/1999 Klauke et al. ..... D9/695
5,954,272 A * 9/1999 Liao ..... 239/317
5,957,387 A * 9/1999 Porta et al. ..... 239/312
6,012,650 A * 1/2000 Hadar ..... 239/317
6,068,204 A * 5/2000 Alexander ..... 239/310
6,102,308 A * 8/2000 Steingass et al. ..... 239/424.5
6,230,982 B1 * 5/2001 Newton ..... 239/10
6,240,983 B1 * 6/2001 Beldham et al. ..... 141/100
6,254,015 B1 * 7/2001 Abplanalp ..... 239/318
6,283,385 B1 * 9/2001 Beaver et al. ..... 239/10
6,345,773 B1 * 2/2002 Shanklin et al. ..... 239/318
6,371,385 B1 * 4/2002 Schiller et al. ..... 239/310
6,378,785 B1 * 4/2002 Dodd ..... 239/318
6,412,666 B1 7/2002 Hogan et al.
6,425,534 B2 * 7/2002 Ketcham et al. ..... 239/316
6,461,361 B1 * 10/2002 Epstein ..... 606/82
6,471,141 B2 * 10/2002 Smith et al. ..... 239/10
D474,256 S 5/2003 Hubmann et al.
6,578,776 B1 * 6/2003 Shanklin et al. ..... 239/318
6,585,714 B2 7/2003 Lopez
6,604,546 B1 * 8/2003 Gilmore ..... 137/550
6,619,318 B2 * 9/2003 Dalhart et al. ..... 137/565.34
6,669,048 B2 * 12/2003 Eva et al. ..... 220/524
6,672,520 B2 * 1/2004 Shanklin et al. ..... 239/318
6,695,891 B2 * 2/2004 Reid ..... 55/495
6,708,901 B2 * 3/2004 Hubmann et al. ..... 239/310
6,749,133 B1 * 6/2004 Ketcham et al. ..... 239/318
6,752,297 B1 * 6/2004 Ische ..... 222/464.7
6,758,372 B2 7/2004 Studer et al.
6,758,411 B2 * 7/2004 Conway et al. ..... 239/303
6,772,966 B2 * 8/2004 Foster et al. ..... 239/581.2
6,857,530 B2 * 2/2005 Yourist ..... 215/10
6,913,209 B2 * 7/2005 Shanklin et al. ..... 239/318
6,948,451 B2 * 9/2005 Bond et al. ..... 119/665
6,976,603 B1 * 12/2005 Johnston et al. ..... 220/530
7,188,786 B2 * 3/2007 Dodd ..... 239/310
2003/0006247 A1 1/2003 Olivier et al.
2003/0075565 A1 4/2003 Gerenraich et al.
2004/0135011 A1 7/2004 Shanklin et al.
2004/0140372 A1 7/2004 Englhard et al.

* cited by examiner

LIQUID SPRAYER ASSEMBLY

CROSS-REFERENCE TO RELATED APPLICATIONS

The present application is a continuation-in-part of U.S. patent application Ser. No. 10/974,708, filed on Oct. 28, 2004, now U.S. Pat. No. 7,188,786 entitled "Hose-End Sprayer Assembly", herein incorporated by reference in its entirety.

BACKGROUND OF THE INVENTION

1. Field of the Invention

This invention relates broadly to liquid sprayers. More particularly, this invention relates to liquid sprayers for dispensing a product by aspiration into the flow of a carrier liquid on connection of the sprayer to a pressurized source of the carrier liquid, such as to the end of a hose.

2. State of the Art

A number of hose-end sprayer assemblies have been developed for siphoning of liquid product from an attached container and discharging the siphoned liquid product in diluted form by a carrier liquid delivered by the hose. U.S. Pat. No. 6,378,785, commonly owned by assignee of the present invention, discloses an exemplary hose-end sprayer assembly that has a single valve for regulating between off, rinse and spray operational modes.

While such a sprayer represents a marked improvement over prior siphoning-type hose-end sprayers for garden, lawn and hard-surface applications, the sprayer is capable of siphoning from one liquid container at a time. Thus, for applications that require multiple products, the user must change out containers. In other applications that require mixing of two products, the two products must be mixed in a container before attachment to the hose-end sprayer. These operations are cumbersome and awkward and limit the commercial success of the sprayer in such applications.

Thus, there remains a need in the art for a siphoning-type hose-end sprayer that is readily adapted for siphoning one or more liquid products selectively and possibly mixing liquid products to fit various needs and uses.

SUMMARY OF THE INVENTION

It is therefore an object of the invention to provide a siphoning-type hose-end sprayer that is readily adapted for siphoning one or more liquid products selectively and possibly mixing liquid products to fit various needs and uses.

It is another object of the invention to provide such a siphoning type hose-end sprayer that ensures proper mounting and orientation of a liquid storage container connected thereto.

It is a further object of the invention to provide a dual chamber liquid sprayer that ensures proper mounting and orientation of the two liquid storage chambers connected thereto.

In accord with these objects, which will be discussed in detail below, an improved liquid sprayer assembly is provided for connection to a container which preferably includes two liquid storage compartments. The assembly includes a housing with a container mount having an underside with at least one structure that is operably interposed with corresponding structure on a neck portion of the container such that container mount is fixed in a predetermined orientation relative to the container. A cap locks the container mount to the neck portion of the container. Preferably, the at least one structure of the container mount comprises a pair of wedge-shaped wall structures together with a plurality of wall structures that extend in a direction substantially parallel to the central axis of the mount/neck. The wedge-shaped wall structures are radially disposed opposite one another about the central axis of the container mount/neck and fit within wedge-shaped voids defined by the neck portion of the container. The plurality of wall structures are operably disposed adjacent corresponding surfaces defined by the neck portion of the container.

It will be appreciated that the shape and geometry of the structural elements of the container mount and the container neck prevents a user from connecting the wrong container to the container mount while also ensuring that the container is properly oriented when connected to the container mount.

According to one embodiment of the invention, the sprayer employs a hose end connector as well as a venturi tube for aspirating liquid from the container. A diverter mechanism, which is mounted within the housing, selectively couples the liquid storage compartment(s) of the container to the inlet port of the venturi tube, and a flow control valve controls the flow of pressurized liquid supplied from the hose end into the venturi tube.

Additional objects and advantages of the invention will become apparent to those skilled in the art upon reference to the detailed description taken in conjunction with the provided figures.

DETAILED DESCRIPTION

Figure 1A:
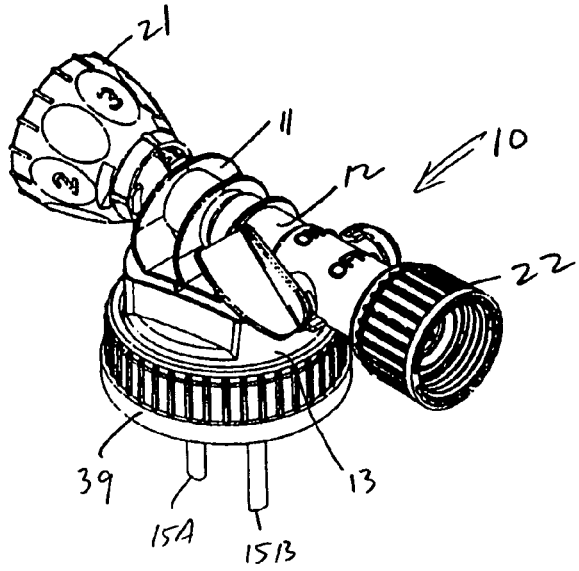
FIG. 1A is a perspective view of an exemplary hose-end liquid sprayer assembly in accordance with the present invention.
Figure 1B:
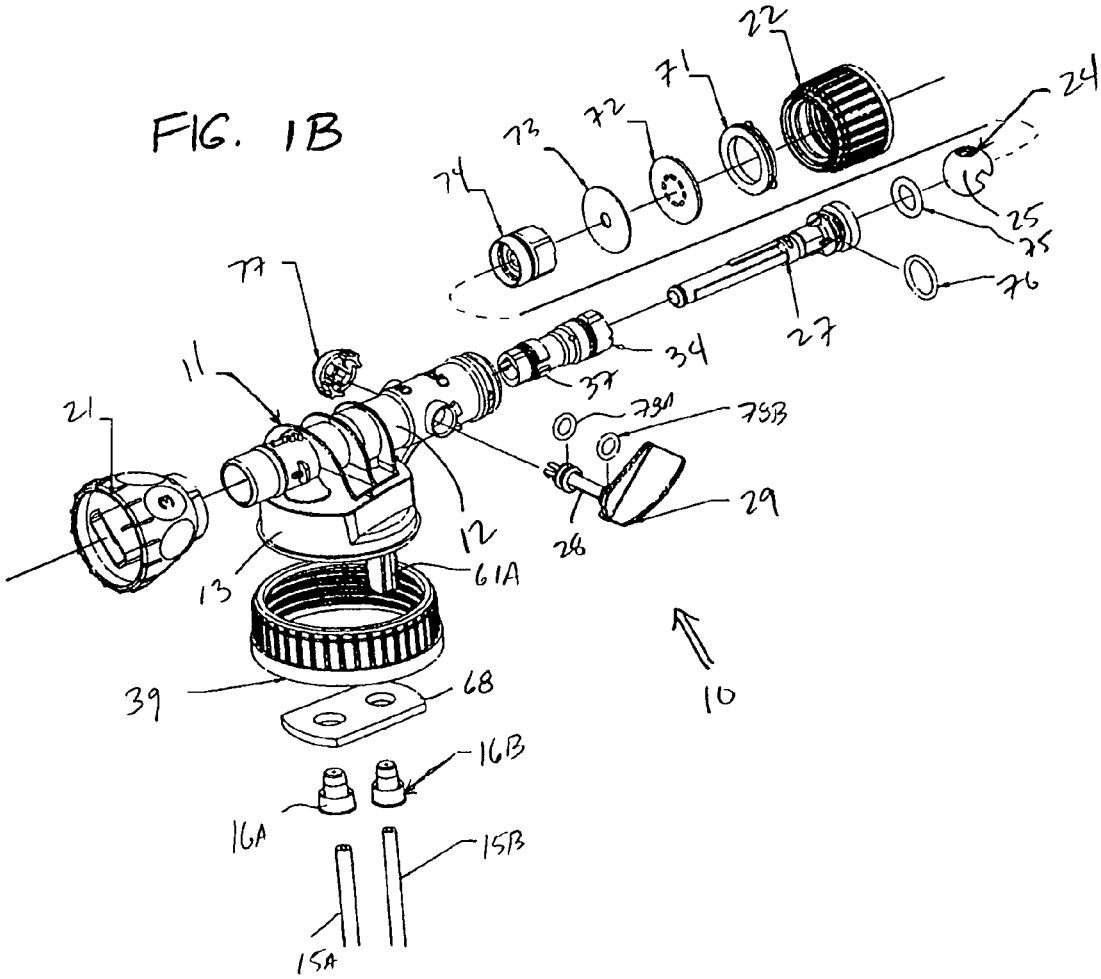
FIG. 1B is an exploded perspective view of the hose-end liquid sprayer assembly of FIG. 1A in accordance with the present invention.
Figure 2:
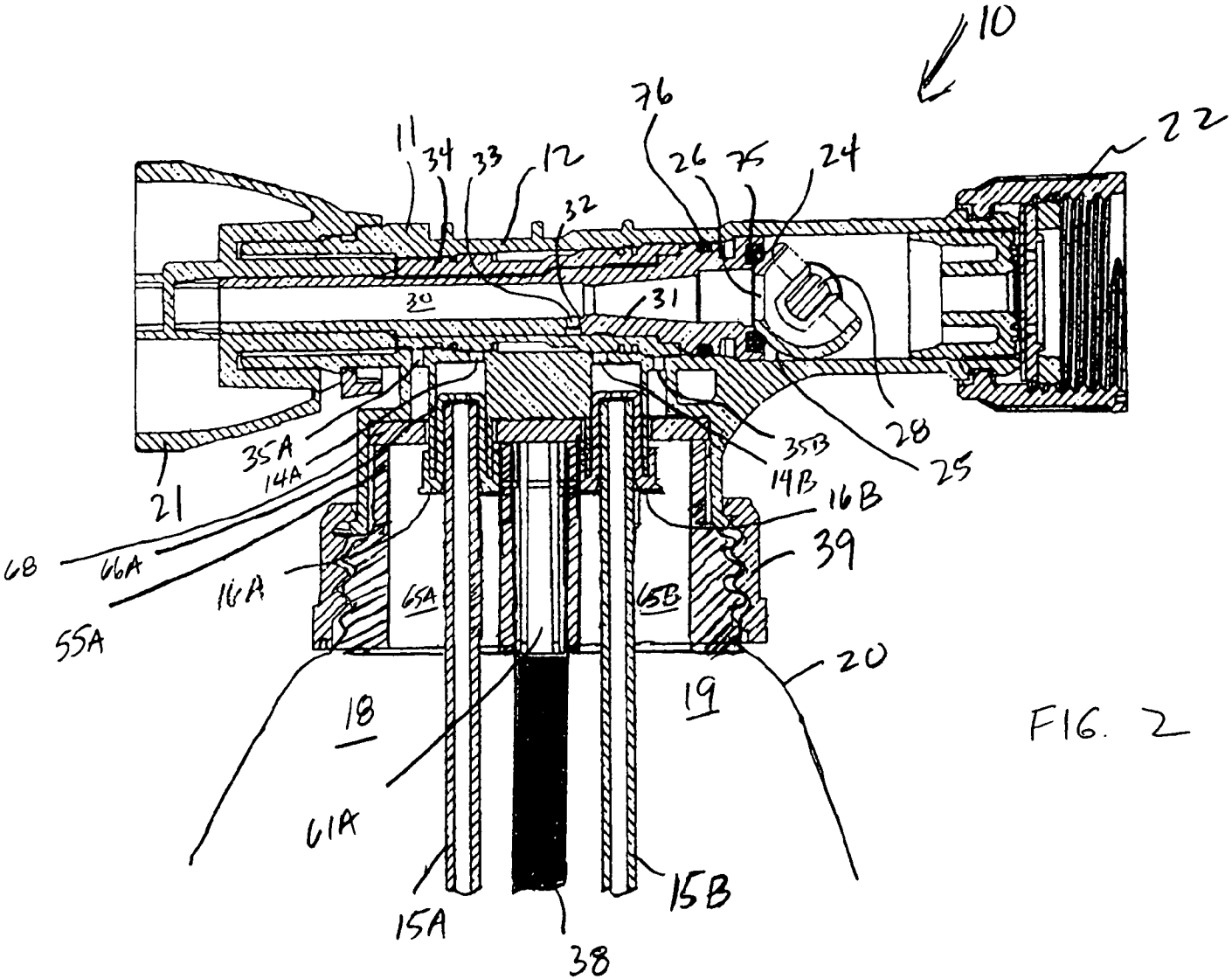
FIG. 2 is a cross-sectional view of the liquid sprayer assembly of FIGS. 1A and 1B mounted on a container, taken substantially in the plane defined by the longitudinal axis of the housing and the central axis of the container mount/container.

Turning now to FIGS. 1A and 1B, a hose-end sprayer assembly 10 according to the present invention includes a housing 11 having an elongate tubular portion 12 with an integral or otherwise connected container mount 13. The housing 11 defines a first liquid product inlet opening 14A (FIG. 2) in communication with a first dip tube 15A, and a second liquid product inlet opening 14B in communication with a second dip tube 15B. The dip tubes 15A, 15B are suspended from the container mount 13 by couplers 16A, 16B, respectively and extend into two separate liquid storage compartments 18, 19 of a bifurcated container 20 (FIG. 2).

An external member 21 is coupled to the forward end of the tubular portion 12 for free rotation in either direction (e.g., clockwise or counter-clockwise rotation) about the central axis of portion 12. The external member 21 functions as a selector grip and thus may be cup-shaped for easy manipulation by the user. An internally-threaded hose closure 22 is coupled to the opposite, rearward end of the tubular portion 12 for mounting the sprayer assembly 10 to the end of a garden hose (not shown) or the like, which provides a pressurized supply of a carrier fluid (e.g., water). The hose closure 22 preferably contains a hose washer 71 as well as an anti-siphon regulator 72, an anti-siphon valve 73 and an anti-siphon seal 74 that aids in prohibiting the siphoning of liquid product upstream from the container 20 into the main water supply provided by the attached garden hose.

A flow control valve, which is preferably realized by a ball valve 24 having a semispherical valve surface 25 with a through opening 26 (FIG. 2), and an elongate venturi tube 27 are mounted within the tubular portion 12. An O-ring 75 provides a seal between the valve surface 25 and the inlet of the venturi tube 27. An O-ring 76 provides a seal between the venturi tube 27 and the tubular portion 12 of the housing 11. The flow control valve 24 is fluidly coupled between the closure 22 and the venturi tube 27. A control assembly (e.g., connector rod 28, control handle 29, shaft lock 77, and O-ring seals 78A, 78B) operably coupled to the valve 24 is provided that controls the flow rate of carrier fluid (e.g., water) supplied from the garden hose or the like through the venturi tube 27.

The venturi tube 27 is mounted within the tubular portion 12 such that it is capable of free rotation about its longitudinal axis. It defines a duct 30 (FIG. 2) extending between its opposite ends. A portion 31 of the duct necks down and then enlarges at junction 32. A port 33 downstream from junction 32 is selectively fluidly coupled to fluid supply paths from the two liquid storage compartments of the container for aspirating product therefrom into the flow of carrier fluid through the duct 30 utilizing venturi action.

A diverter tube 34 is mounted within the tubular portion 12 in surrounding relation with respect to the venturi tube 27. In the preferred embodiment, the diverter tube 34 is keyed to the venturi tube 27 such that the two components rotate together upon manual rotation of selector grip 21. Alternatively, the diverter tube 34 can be integrally formed with the venturi tube 27. In any event, the diverter tube 34 functions as a rotary valve for the selective control over the supply of liquid products into the duct 30 via port 33. More particularly, the geometry of the diverter tube 34 is adapted such that a fluid path between the port 33 of the venturi tube 27 and either none, one or both of the liquid supply compartments 18, 19 of the container 20 is selected at different rotational positions of the selector grip 21/diverter tube 34/venturi tube 27. For example, at one rotational position, the port 33 of the venturi tube 27 is fluidly isolated from both liquid supply compartments 18, 19. In another rotation position, the port 33 of the venturi tube 27 is fluidly coupled to one of the liquid supply compartments (e.g., compartment 18 for Product A). In yet another rotation position, the port 33 of the venturi tube 27 is fluidly coupled to the other liquid supply compartment (e.g., compartment 19 for Product B). And in another rotation position, the port 33 of the venturi tube 27 is fluidly coupled to both liquid supply containers (e.g., compartment 18 for Product A as well as compartment 19 for Product B).

The housing 11 and diverter tube 34 preferably also include vent means for venting the two liquid storage compartments 18, 19 of the container 20 during use. Such vent means (e.g., vent ports 35A, 35B and vent pads 37) are described in detail in U.S. patent application Ser. No. 10/974,708, incorporated by reference in its entirety.

The flow control valve assembly 24 is preferably adapted to have three different operational modes as follows:

i) mode 1: the supply of the carrier fluid to the venturi tube 27 is shut off;

ii) mode 2: the supply of carrier fluid to the venturi tube 27 is turned on at a flow rate that causes aspiration of liquid product from the selected containers (e.g., selected by rotation of the selector grip 21/diverter tube 34/venturi tube 27); and iii) mode 3: the supply of carrier fluid to the venturi tube 27 is turned on at a flow rate that does not cause aspiration (water only, rinse mode).

Figure 6:
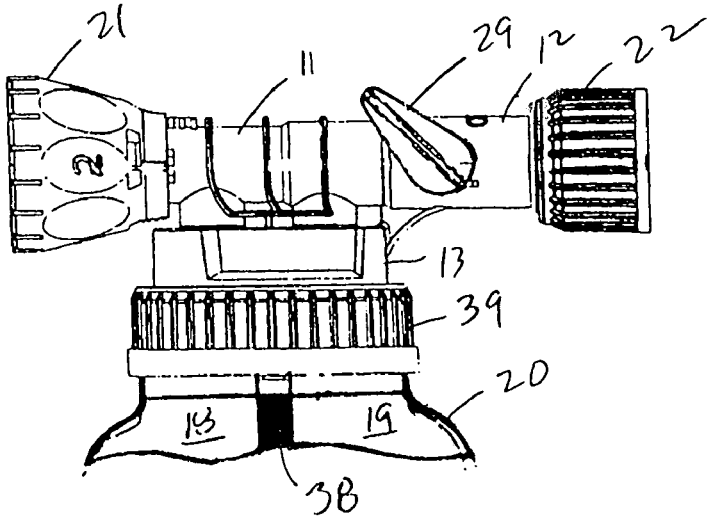
FIG. 6 is a side elevational view of the hose-end sprayer assembly of FIGS. 1A and 1B mounted to a container.

The container 20 preferably has a partition 38 separating the container into two liquid storage compartments 18, 19 for storing liquid Product A and liquid product B, respectively, as shown in FIG. 6. Alternatively, the compartments for products A and B may be formed by separate container halves coupled together by the container mount 13 and cap 39.

Figure 3:
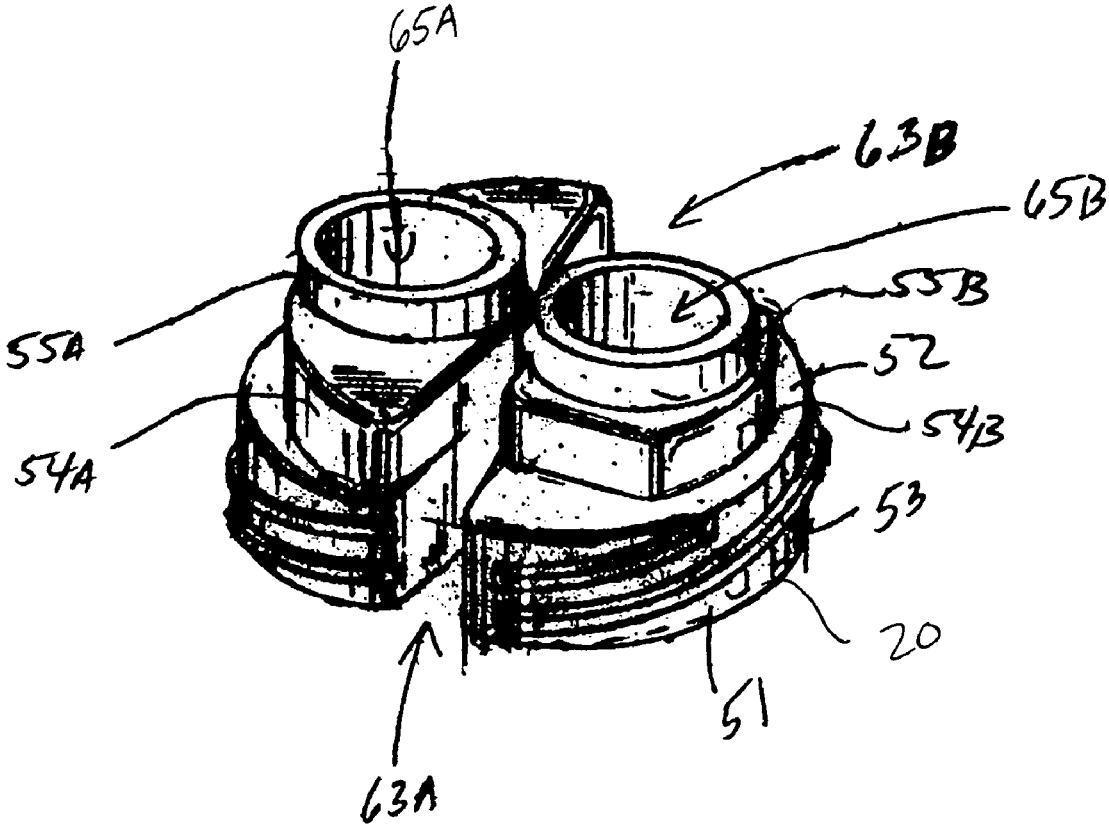
FIG. 3 is an exploded perspective view of the neck of the container of FIG. 2.

As shown in FIG. 3, the neck of the container 20 includes a base portion 51 having a side surface with threads 53 that engage the internal threads of the cap 39. Alternatively, the side surface of base portion 51 can include other structural elements (such as ribs or other suitable means) that lock to corresponding internal structural elements of the cap 39. A plurality of structural elements (e.g., half-circular section 54A and truncated half-circular section 54B together with corresponding annular rims 55A and 55B) extend upward from the top surface 52 of the base portion 51. The shape and geometry of these structural elements is keyed to the shape and geometry of the structure of the underside (FIGS. 4 and 5) of the container mount 13 in a manner that prevents a user from connecting the wrong container to the container mount 13 while also ensuring that the container 20 is properly oriented when connected to the container mount 13. In the proper orientation, the first liquid product inlet opening 14A and the first dip tube 15A are properly oriented with a fluid path (e.g., passageway 65A) to the first liquid storage compartment 18, and the second liquid product inlet opening 14B and the second dip tube 15B are properly oriented with a fluid path (e.g., passageway 65B) to the second liquid storage compartment 19.

Figure 4:
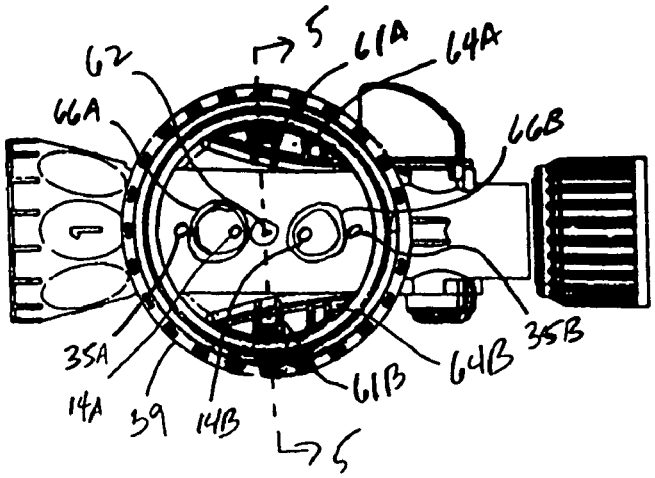
FIG. 4 is a bottom view of the liquid sprayer assembly of FIGS. 1A and 1B.
Figure 5:
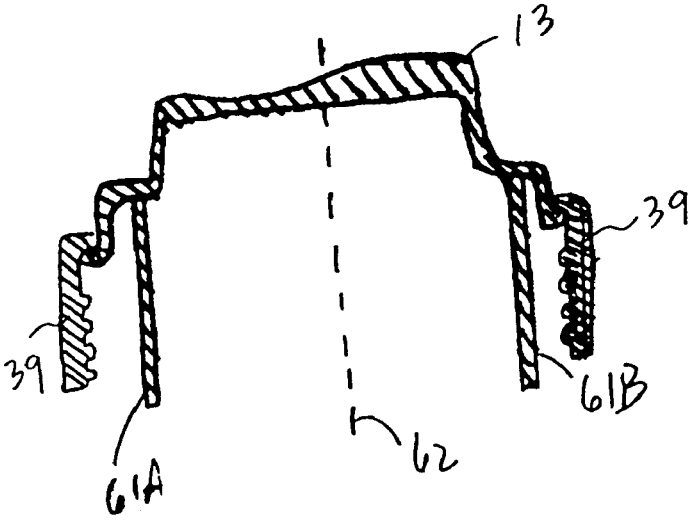
FIG. 5 is cross-sectional view of the underside of the container mount of FIGS. 1A and 1B, showing a portion of a wedge-shaped wall structure extending therefrom.

In the exemplary embodiment as shown in FIGS. 4 and 5, the underside of the container mount 13 includes two wedge-shaped wall structures 61A, 61B that are radially disposed opposite one another relative to the central axis 62 of the container mount 13 and extend in a direction parallel to central axis 62 (which is orthogonal to the longitudinal axis of the elongate housing 12). These wedge-shaped wall structures 61A, 61B fit into corresponding wedge-shaped voids 63A, 63B defined by the half-circular section 54A, the truncated half-circular section 54B and the base portion 51 as shown in FIG. 3. The underside of the carrier mount 13 also includes two pairs of walls 64A, 64B that are offset laterally from the wedge-shaped wall structures 61A, 61B. The wall pairs 64A, 64B extend downward in a directional parallel to the central axis 62 and are operably disposed adjacent to (or close to) the top surface 52 of the base portion in areas adjacent the truncated half-circular section 54B. The wall pairs 64A, 64B thus act to orient the container mount 13 relative to the container 20 as they will hit half-circular section 54A in non-proper orientations, thereby preventing/blocking engagement of the container mount 13 and cap 39 with the container neck. In particular, the exemplary structural features of the container neck and the underside of the container mount 13 prevent a user from connecting the wrong container to the container mount 13 while also ensuring that the container 20 is properly oriented when connected to the container mount 13 with the first compartment 18 located forward and the second compartment 19 located rearward. In this orientation, the first liquid product inlet opening 14A and the first dip tube 15A are properly oriented with the passageway 65A into the first compartment 18, and the second liquid product inlet opening 14B and the second dip tube 15B are properly oriented with the passageway 65B into the second compartment 19. The shape and geometry of such structural features can readily be modified without altering the scope of the invention. For example, such structural features may include slots and/or grooves with corresponding mating walls, holes with corresponding posts, or other suitable means.

The structural features of the container neck and the underside of the container mount that ensure proper mounting have a directional component extending along the central axis of the container neck. It is not essential that these elements extend exactly parallel to the central axis of the neck. For example, such elements can be inclined relative to the central axis of the neck so that some rotation of the cap 39 on the container 20 is necessary to engage the structural elements. Such rotation may be in the same (or the opposite sense) of the rotation required to screw the cap 39 onto the container.

The annular rims 55A, 55B of the container neck define corresponding passageways 65A, 65B through the container neck into the respective compartments 18, 19 of the container 20. The underside of the container mount 13 includes cylindrical structures 66A, 66B that extend vertically downward through the annular rims 55A, 55B of the container neck into the passageways 65A, 65B as best shown in FIGS. 2 and 4. The liquid product inlet openings 14A, 14B are located at the top of the cylindrical structures 66A, 66B adjacent passageways 65A, 65B. The dip tubes 15A, 15B are suspended from within the corresponding cylindrical structures 66A, 66B by couplers 16A, 16B, respectively, and extend into corresponding liquid storage compartments 18, 19 of the container 20. The vent ports 35A, 35B are provided in the underside of the container mount 13 outside the cylindrical structures 66A, 66B and above the outline of the corresponding annular rims 55A, 55B to provide for venting of the two liquid storage compartments 18, 19 of the container 20 during use. The seal 68 seals the underside of the container mount 13 to the annular rims 55A, 55B of the container neck (FIG. 2). FIG. 6 shows the assembled hose-end sprayer of the present invention attached to the container 20.

Advantageously, the hose-end sprayer assembly of the present invention is versatile in that it can be simply adapted for the aspiration of a single liquid product, a select one of two liquid products, and the mixture of two liquid products. Moreover, the irregular structural features of the container neck and the underside of the container mount prevents a user from connecting the wrong container to the container mount while also ensuring that the container is properly oriented when connected to the container mount. Furthermore, the assembly has few parts which makes it economical to produce and assemble, and it is easy to operate.

There have been described and illustrated herein an embodiment of a hose-end sprayer assembly. While particular embodiments of the invention have been described, it is not intended that the invention be limited thereto, as it is intended that the invention be as broad in scope as the art will allow and that the specification be read likewise. Thus, while a dual chamber hose-end sprayer is described, particular features of the sprayer, such as the shape and geometry of the container neck and container mount for proper container mounting can be used in conjunction with a single chamber hose-end sprayer design or other liquid sprayer designs. Likewise, the dual flow path aspiration mechanism of the hose-end sprayer assembly (which is realized by the dual fluid inlet passageways of the container mount and the diverter tube in conjunction with the venturi tube) can be mounted on a container with one liquid storage compartment. In this configuration, user control of the dual flow path aspiration mechanism allows the user to select from two different spray ratios for the liquid held in the one liquid storage compartment. Also, while external pads are shown on the diverter tube for controlling the opening and closing of vent ports, it will be appreciated that rings with cutouts or other known external means could be used for vent control as well. Likewise, external pads defining gaps or other suitable means can replace the rings with cutouts for controlling the opening and closing of the product inlet openings. In addition, while particular types of flow control valves (e.g., ball valves) have been disclosed for controlling the flow of carrier fluid, it will be understood that other know liquid shutoff valves can be used. Moreover, while particular configurations have been disclosed in reference to the irregular shape and geometry of the container neck and mount, it will be appreciated that other configurations could be used as well. Moreover, additional features, such a nozzle with user-selectable spray patterns, can be added to the hose-end spray assembly as described herein. It will therefore be appreciated by those skilled in the art that yet other modifications could be made to the provided invention without deviating from its spirit and scope as claimed.

What is claimed is:

1. A liquid sprayer for use with at least one container of liquid product to be dispensed, the at least one container having a neck portion, the sprayer comprising:

a housing having a container mount for connecting to the at least one container with two liquid storage compartments therein, said container mount having an underside with at least one structure that is operably interposed with corresponding structure on the neck portion such that said container mount is fixed in a predetermined orientation relative to the at least one container;

a cap, separate and distinct from said container mount and operably coupled to said container mount, for locking said container mount to the neck portion of the at least one container;

a house connector, operably coupled to the housing, for connection to a hose end that supplies a source of pressurized liquid;

a first tubular structure, mounted within or integral to said housing, having a duct through which flows pressurized liquid supplied from the hose end, wherein the duct has a portion that necks down and then enlarges at a junction with the at least one container for aspirating liquid therefrom into the flow of liquid supplied from the hose end and passing through the duct; and a diverter mechanism, mounted within or integral to said housing, that selectively couples zero, one or both of the two liquid storage compartment of the container to the port of said first tubular structure;

wherein, the neck portion of the at least one container comprises a central axis, and the at least one structure of the container mount and the corresponding structure of the neck portion extend along a direction substantially parallel to the central axis; and the at least one structure of the container mount further comprises a pair of wedge shaped wall structures that are radially disposed opposite one another about the central axis, wherein said wedge-shaped structures fit within wedge-shaped voids defined by the neck portion of the at least one container.

2. A liquid sprayer according to claim 1, wherein:

the at least one structure of the container mount and the corresponding structure of the neck portion block the container mount from engaging the at least one container when said container mount is disposed in other predetermined orientations relative to the at least one container.

3. A liquid sprayer according to claim 1, wherein:

said container mount has at least one fluid supply inlet and corresponding dip tube in fluid communication therewith, the at least one structure of the container mount and the corresponding structure of the neck portion allowing said fluid supply inlet and said dip tube to be fluid coupled to a fluid pathway through the neck portion and into the container when said container mount is fixed in said predetermined orientation relative to the at least one container, and the at least one structure of the container mount and the corresponding structure of the neck portion blocking fluid coupling of said fluid supply inlet and said dip tube to the fluid pathway through the neck portion and into the container when said container mount is fixed in other orientations relative to the at least one container.

4. A liquid sprayer according to claim 1, wherein:

said cap is rotatable about the central axis relative to said container mount and has an internal thread that interfaces to an external thread on the neck portion of the at least one container.

5. A liquid sprayer according to claim 1, wherein:

said housing is elongate with a longitudinal axis that is oriented substantially orthogonal relative to the central axis.

6. A liquid sprayer according to claim 1, wherein:

said at least structure of the container mount comprises a plurality of wall structures that are operably disposed adjacent corresponding surfaces defined by the neck portion of the at least one container.

7. A liquid sprayer according to claim 6, wherein:

the neck portion of the at least one container comprises a base portion having a top surface with a half-circle section and a truncated half-circle section extending therefrom, wherein said plurality of wall structures of said container mount are operably disposed adjacent to said top surface in areas adjacent said truncated half-circle section.

8. A liquid sprayer according to claim 1, wherein:

said diverter mechanism comprises a second tubular structure that surrounds said first tubular structure.

9. A liquid sprayer according to claim 8, further comprising:

a grip selector mounted on one end of the housing opposite said hose connector.

10. A liquid sprayer according to claim 9, wherein:

said grip selector, said first tubular structure, and said second tubular structure are rotatable within said housing, whereby different rotation positions selectively couple zero, one or both of the two liquid storage compartments of the container to the port of said first tubular structure.

11. A liquid sprayer according to claim 1, further comprising:

a flow control valve for controlling the flow of pressurized liquid supplied from the hose end into the duct of said first tubular structure.

12. A liquid sprayer according to claim 11, wherein:

said flow control valve comprises a semi-hemispherical ball with a through-hole therethrough, said ball rotatable about a transverse axis relative to the duct.

13. A liquid sprayer according to claim 1, wherein:

the housing comprises venting means for venting the at least one container.

14. A liquid sprayer comprising:

at least one container with first and second liquid storage compartments and a neck portion;

a housing having a container mount for connection to said at least one container, said container mount having an underside with at least one structure that is operably interposed with corresponding structure on the neck portion such that said container mount is fixed in a predetermined orientation relative to the at least one container;

a cap, separate and distinct from said container mount and operably coupled to said container mount, for locking said container mount to the neck portion of the at least one container;

a hose connector, operably coupled to the housing, for connection to a hose end that supplies a source of pressurized liquid;

a first tubular structure, mounted within or integral to said housing, having a duct through which flows pressurized liquid supplied from the hose end, wherein the duct has a portion that necks down and then enlarges at a junction with a port downstream from the junction, wherein the port is in fluid communication with said container for aspirating liquid therefrom into the flow of liquid supplied from the hose end and passing through the duct, and a diverter mechanism, mounted within or integral to said housing, that selectively couples zero, one or both of the two liquid storage compartments of said container to the port of said first tubular structure;

wherein, the neck portion of the at least one container comprises a central axis, and the at least one structure of the container mount and the corresponding structure of the neck portion extend along a direction substantially parallel to the central axis; and the at least one structure of the container mount further comprises a pair of wedge shaded wall structures that are radially disposed opposite one another about the central axis, wherein said wedge shaped structures fit within wedge-shaped voids defined by said neck portion of said at least one container.

15. A liquid sprayer according to claim 14, wherein:

the at least one structure of the container mount and the corresponding structure of the neck portion block the container mount from engaging the at least one container when said container mount is disposed in other predetermined orientations relative to the at least one container.

16. A liquid sprayer according to claim 14, wherein:

said container mount has first and second fluid supply inlets and corresponding first and second dip tubes in fluid communication therewith and said neck portion of said container define first and second fluid pathways through the neck portion and into said first and second liquid storage compartments, respectively, wherein the at least one structure of the container mount and the corresponding structure of the neck portion allows said first and second fluid supply inlets and said first and second dip tube to be fluid coupled to said first and second fluid pathways when said container mount is fixed in said predetermined orientation relative to the at least one container, and wherein the at least one structure of the container mount and the corresponding structure of the neck portion blocking fluid coupling of said first and second fluid supply inlets and said first and second dip tubes to said first and second fluid pathways when said container mount is fixed in other orientations relative to the at least one container.

17. A liquid sprayer according to claim 14, wherein:

said cap is rotatable about the central axis relative to said container mount and has an internal thread that interfaces to an external thread on the neck portion of the at least one container.

18. A liquid sprayer according to claim 14, wherein:

said housing is elongate with a longitudinal axis that is oriented substantially orthogonal relative to the central axis.

19. A liquid sprayer according to claim 14, wherein:

Said at least one structure of the container mount further comprises a plurality of wall structures that are operably disposed adjacent corresponding surfaces defined by said neck portion of said at least one container.

20. A liquid sprayer according to claim 19, wherein:

said neck portion of said at least one container comprises a base portion having a top surface with a half-circle section and a truncated half-circle section extending therefrom, wherein said plurality of wall structures of said container mount are operably disposed adjacent to said top surface in areas adjacent said truncated half-circle section.

21. A liquid sprayer according to claim 14, wherein:

said diverter mechanism comprises a second tubular structure that surrounds said first tubular structure.

22. A liquid sprayer according to claim 21, further comprising:

a grip selector mounted on one end of the housing opposite said hose connector.

23. A liquid sprayer according to claim 22, wherein:

said grip selector, said first tubular structure, and said second tubular structure are rotatable within said housing, whereby different rotation positions selectively couple zero, one or both of the two liquid storage compartments of the container to the port of said first tubular structure.

24. A liquid sprayer according to claim 14, further comprising:

a flow control valve for controlling the flow of pressurized liquid supplied from the hose end into the duct of said first tubular structure.

* * * * *